United States Patent [19]

Bertram et al.

[11] 4,246,025

[45] Jan. 20, 1981

[54] BENEFICIATION PROCESS FOR OXIDIZED IRON ORE

[75] Inventors: Edward F. Bertram; Philip Harris; Darrell W. Myroniuk, all of Edmonton, Canada

[73] Assignee: Alberta Research Council, Edmonton, Canada

[21] Appl. No.: 955,973

[22] Filed: Oct. 30, 1978

[51] Int. Cl.[3] ..... C21B 13/04

[52] U.S. Cl. ..... 75/37; 75/252

[58] Field of Search ..... 75/1 R, 1 T, 3, 4, 5, 75/21, 29, 33, 37, 34, 0.5 BA, 229, 243, 252

[56] References Cited

U.S. PATENT DOCUMENTS

| | | | |
|---|---|---|---|
| 3,637,369 | 1/1972 | Sebenik et al. | 75/34 |
| 3,823,011 | 7/1974 | Sebenik et al. | 75/34 |
| 3,854,929 | 12/1974 | Stewart et al. | 75/1 R |
| 4,047,934 | 9/1977 | Polland et al. | 75/21 |
| 4,065,294 | 12/1977 | Barker | 75/1 |

FOREIGN PATENT DOCUMENTS

| | | | |
|---|---|---|---|
| 473854 | 9/1974 | Australia | 75/21 |
| 990512 | 6/1976 | Canada | 75/23 |
| 2443978 | 4/1976 | Fed. Rep. of Germany | 75/0.5 BA |
| 2547574 | 10/1974 | United Kingdom | 75/33 |

*Primary Examiner*—L. Dewayne Rutledge
*Assistant Examiner*—Michael L. Lewis
*Attorney, Agent, or Firm*—Max L. Wymore

[57] ABSTRACT

A chlorine source is provided in a reactor in combination with a ground oxidized ore and a particulate carbonaceous reductant. The amount of chlorine provided is significantly less than the stoichiometric requirements for reaction with the total iron content of the ore; the amount of the reductant is greater than that required to effect the reduction of the total iron content of the ore. The reactor is operative to retain the reaction gases in intimate contact with the feedstock mixture without significant dilution of said gases in order to provide a reducing atmosphere. The mixture is indirectly heated to a temperature below 950° C., preferably in the range 700°–950° C., and the mixture is retained in the reactor for a period of time sufficient to cause the major portion of the iron to be transported out of the ore and to be deposited on or near the solid reductant and form discrete metal particles. These particles can be separated from the gangue minerals, for example by magnetic separation, to provide a high yield-high quality iron concentrate.

3 Claims, 10 Drawing Figures

Fig. 5.

75 g. Snake River iron ore, dried, 30 mesh (58.0 % Fe, 9.6 % A.I.)
10 g. $FeCl_2 \cdot 4H_2O$
22.50 g. Charcoal
1.2 g. $CaCO_3$ muffle furnace at 910°C for 2 hours Screen

| -100 mesh | | | +100 mesh |
|---|---|---|---|
| | Distribution | | |
| 64.5 | % of Fe | | 35.5 |
| 45.7 | % of A.I. | | 54.3 |
| Grind | | | Grind |
| Magnetic Separation | | | Magnetic Separation |
| Magnetics | Non-magnetics | | Magnetics | Non-magnetics |
| | Distribution | | |
| 56.2 | 8.2 | % of Fe | 31.4 | 4.1 |
| 1.8 | 43.9 | % of A.I. | 2.6 | 51.7 |
| | Analysis | | |
| 84.7 | 20.7 | % Fe | 87.4 | 22.4 |
| 0.8 | 33.6 | % A.I. | 1.4 | 56.4 |
| 0.02 | | % P | 0.025 | |
| 5.04 | | % C | 3.6 | |

% of Recovered Iron in the Two Concentrates - 87.6 %

CONTINUOUS IRON ORE REACTOR

BENEFICIATION PROCESS FOR OXIDIZED IRON ORE

BACKGROUND OF THE INVENTION

This invention relates to a segregation method utilizing chlorination in the presence of a solid reductant at elevated temperature to effect beneficiation of an oxidized iron ore, and to the novel product obtained by the practice of the invention.

The invention finds application with respect to hard-to-beneficiate iron oxide ores in which the iron minerals are finely dispersed in the gangue minerals. The Clear Hills ore of Northwestern Alberta is a case in point. This ore typically contains: 31.87% Fe, 17.70% $SiO_2$, 5.14% $Al_2O_3$, 1.49% $P_2O_5$, 0.03% S and has 25.0% loss on ignition. When this ore is directly reduced in a rotary kiln or fluid bed, the metallized iron concentrate obtained by magnetic separation is of poor quality and extensive grinding and numerous magnetic separation steps are required to yield the concentrate. The main reason for this poor quality if the iron concentrate is inherent in the nature of the ore. The iron- and gangue-bearing minerals are extremely fine, complex and intimately inter-dispersed. When the ore is reduced as is, with either gas or solid reductants, the metallic iron is generated in situ in the ore particles and forms in very fine-grained crystals that do not enlarge and thus require extremely fine grinding of the reduced ore to liberate them from the gangue constituent.

SUMMARY OF THE INVENTION

It is therefore the main object of this invention to provide a process which converts the major part of the contained iron in an ore of this type to a metallized form which may relatively easily be separated from the major part of the gangue minerals to produce a high yield-good quality concentrate.

In accordance with the invention, a chlorine source is provided in a reactor in combination with a ground oxidized ore and a particulate carbonaceous reductant. The amount of chlorine provided is significantly less than the stoichiometric requirements for reaction with the total iron content of the ore; the amount of the reductant is greater than that required to effect the reduction of the total iron content of the ore. The reactor is operative to retain the reaction gases in intimate contact with the feedstock mixture, without said gases being significantly diluted with inert or non-reactive gases. The mixture is indirectly heated to a temperature below about 950° C., preferably in the range 700° C.–950° C., and the mixture is retained in the reactor for a period of time sufficient to cause the major part of the iron to be transported out of the ore and to be deposited on or near the solid reductant and form discrete metal particles. These particles can relatively easily be separated from the gangue minerals, as by magnetic separation, and a high yield-high quality concentrate may be obtained.

The chlorine source can be chlorine gas or a chlorine compound, such as ferrous chloride.

The reductant preferably is a form of carbon, such as coal char, charcoal or coke.

An explanation of my best understanding of the process reactions is now given, although I do not expect to be bound by said explanation. In the case where the chlorine source is a chlorine compound, the process appears to be initiated by the production of chlorine gas through reduction of the chlorine source. The chlorine gas then selectively attacks the iron oxides, apparently converting these to gaseous chlorides which can readily diffuse or be transported out of the ore particles. This reaction requires a reducing atmosphere, as exemplified in equation (1)

$$Fe_2O_3+3CO(g)+2Cl_2(g)\rightarrow FeCl_2(g)+3CO_2(g) \quad (1)$$

It seems thermodynamically unfeasible that the iron chloride be immediately reduced by the solid carbon reductant or by carbon monoxide. Instead the iron chloride appears to react to form an oxide and to regenerate the chloride as shown in equation (2).

$$2FeCl_2+3[O]\rightarrow Fe_2O_3+Cl_2 \quad (2)$$

The oxide is then reduced on or near the solid carbon reductant.

$$2Fe_2O_3+3C(s)\rightarrow 2Fe+3CO_2$$

Thus the chlorine initially supplied is mostly recovered as chlorine gas and serves as a catalyst, the products of the overall reaction being principally metallic iron and carbon dioxide.

Both the transport phenomenon and the reduction of the iron to its metallic form must take place in a single reaction vessel. In addition, the reaction mixture must be heated indirectly in order to prevent dilution of the gaseous reactants and to provide a strong reducing atmosphere.

Broadly stated, the invention is a method for beneficiating ground oxidized iron ore containing silica and comprises introducing the ore, a chlorine source and a particulate carbonaceous reductant into a reaction vessel; the amount of the chlorine source being less than the stoichiometric requirement for the reduction of the total iron content of the ore and the amount of reductant being greater than that required to effect the reduction of the total iron content of the ore; indirectly heating the mixture in the vessel without exceeding 950° C., while retaining the reaction gases in intimate contact with the ore without significant dilution of said gases to thereby provide a reducing atmosphere, for a sufficient period of time so as to cause the greatest part of the iron in the ore to be transported out of the ore particles to reduction sites adjacent the reductant where the iron is metallized thereby forming an agglomerate of iron-depleted ore particles and carbonaceous reductant held together by a matrix of interwoven fine strands of substantially metallic iron.

The invention also contemplates a reaction product obtained by heating a mixture of an oxidized iron ore containing silica, a chlorine source and a particulate carbonaceous reductant in a reaction zone, which comprises: one or more agglomerates of iron-depleted ore particles and carbonaceous reductant held together by the greatest part of the iron originally in the ore particles, said iron having been transported from the ore particles and metallized in the interstitial spaces between said ore particles, said iron consisting of a matrix of interwoven fine strands of substantially metallic iron.

DESCRIPTION OF THE DRAWINGS

In the drawings:

FIG. 5 is a flow diagram and tabular data showing the practise of the invention on Snake River ore;

DESCRIPTION OF THE PREFERRED EMBODIMENT

Figure 1:
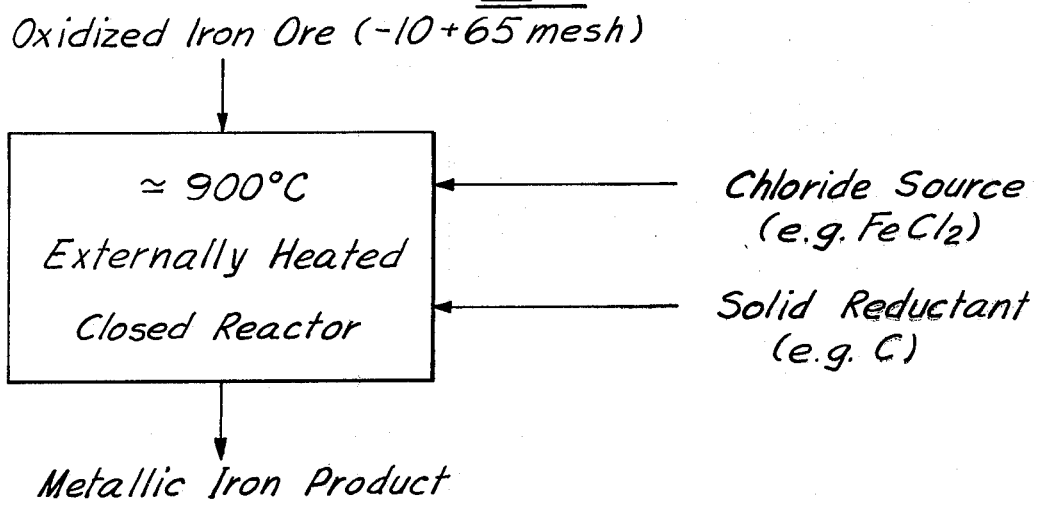
FIG. 1 is a flow diagram broadly showing the process.

The invention has been practiced on oxidized iron ores, with high silica, and which may or may not display a fine grained composition. High quality iron concentrates have been obtained using the Clear Hills ore of Alberta, the Marquette ore of Upper Michigan, U.S. (37.1% iron, 54.2% A.I.), and the Snake River ore of Yukon Territory (44.0% iron, 3.14% A.I. and 0.34% phosphorous). The preferred ore is one containing at least 15 wt. % iron oxides and at least 10 wt. % silica.

Ground ore with a particle size of −10 +65 mesh is preferred. Too large a particle size reduces the free diffusion of gases through the ore. A fine grind, besides requiring more preparation, favors in situ reduction due to the exposure of a large surface area of the ore to the reducing atmosphere.

Various solid carbonaceous reductants may be used: coal (volatiles need not be driven off), coke, char, coconut charcoal and charcoal briquettes have successfully been applied. There are added in, at least, sufficient amounts to effect the reduction of the total iron content of the ore and are preferaby of a fine grind. Preferably, this amount is in excess of 10 wt % based on the ore and most preferably in the range of 15–20 wt. %.

The effect on the process of several coal chars, charcoals, and cokes was tested. The results indicated that the choice of carbon did not affect the yield and quality of the product as significantly as other parameters did. The sulfur present in the carbon reductant should be kept as low as possible to avoid a deleterious transference of the sulfur to the metallic iron product.

The transport effect has been demonstrated for various chlorine sources at differing concentration levels. These include metallic chlorides and their hydrates, either as salts or in solution, and also organic chlorides. The following give some effect, although in varying degrees:

Ferrous chloride, its hydrates and solutions
Calcium chloride, its hydrates and solutions
Magnesium chloride, its hydrates and solutions
Sodium chloride
Potassium chloride
Poly-vinyl chloride
Carbontetrachloride
Limestone and dolomite dissolved in hydrochloric acid
Hydrochloric acid solution.

The amounts of chlorine source required for the desired efficiency are less than the stoichiometric requirement for reaction with the total iron content. This is due to the catalytic effect the chlorine source displays in the process. Large amounts of chlorine would cause the wholesale chlorination of the ore constituents. In addition, the chlorine is selective to the iron oxides over the iron, as evidenced by the fact that the process can be conducted in a cast iron crucible without any detrimental effects to the vessel.

Chlorine enrichment of the feed stock by countercurrent movement of the reaction gases allows for lesser additions in a continuous system. Amounts of chlorine source less than 15 wt. % of the ore have been employed. As little as 4% ferrous chloride has satisfactorily been used.

There is an interaction taking place which parallels the activity of the carbonaceous reductant with the vapor pressure of the chlorine source. Charcoal is more active towards carbon dioxide than is coke, and the vapor pressures of the chlorine salts follow the order of: ferrous chloride > magnesium chloride > calcium chloride. Thus, ferrous chloride gives a better recovery with charcoal while coke gives better recoveries with calcium chloride. This requirement of matching the chloride source to the carbon type of achieve maximum yield and quality is diminished when the process is carried out in a reactor that employs the countercurrent movement of reaction gases to solid feed.

The temperature at which the process is to be conducted, preferably, should be established taking into account the particular combination of chlorine source and solid carbon reductant to be used. For example, coke and calcium chloride produce the highest percent of transported iron at about 938° C. and provide 80% recovery for a 3 hour reaction time. With charcoal and calcium chloride, the maximum transported iron occurred at 888° C. and gave 63.2% recovery for a 3 hour reaction time. Therefore the process is rendered more efficient by careful matching of the feed materials with temperature.

The general experimental procedure for batch runs was to mix the ore, the carbon, and the chloride salt in a crucible, cover the crucible, and dry the mixture, if required. The crucible was then placed in an externally and electrically-heated muffle furnace. It was heated rapidly to the desired temperature and allowed to react for the desired length of time. The crucible was then cooled to room temperature.

The separation procedure varied. In some instances, the reaction product was screened. Generally, the ore was separated, after crushing, using a Davis tube magnetic separator. Grinding was effected with a mortar and pestle.

The reaction products were then analyzed as follows:

The iron and acid insoluble analysis was carried out by dissolving a 0.5 gram sample in 20–30 mls. of hydrochloric acid, followed by dilution and filtration. The insoluble material was washed several times with hot 1% hydrochloric acid and then ignited in a muffle furnace at 900° C. to determine the acid insolubles (A.I.). The filtrate and combined washings were diluted in a volumetric flask. An aliquot was taken and titrated using the standard stannous chloride, mercuric chloride and potassium dichromate method.

The determination of metallic iron was carried out by dissolving the sample in the presence of mercuric chloride, followed by titration with standard dichromate solution.

A gravimetric determination of phosphorous was done by precipitation of the phosphomolybdate complex and weighing the resultant precipitate.

The invention is illustrated by the following examples.

EXAMPLE I

Figure 2:
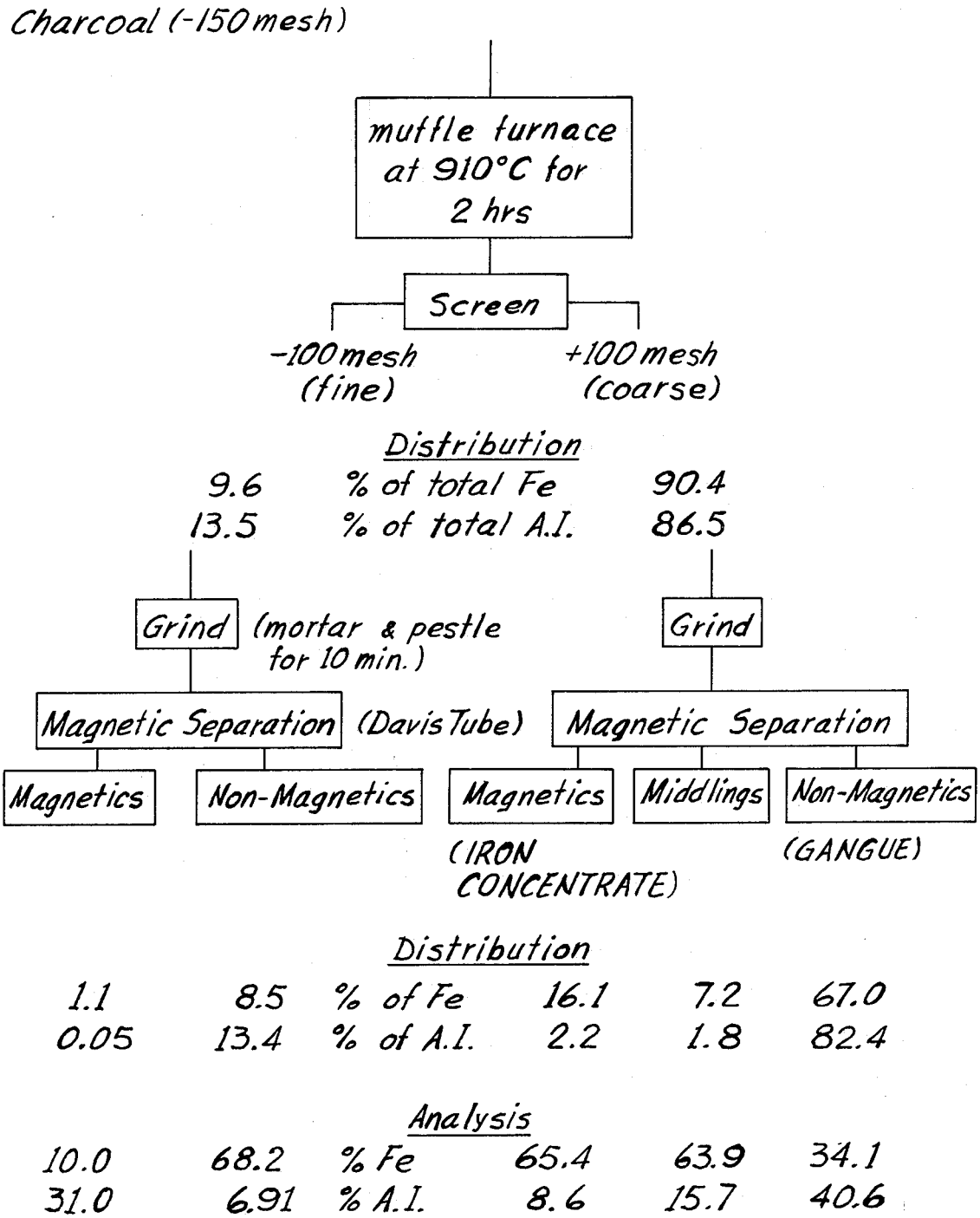
FIG. 2 is a flow diagram and tabular data for an example involving the direct reduction of Clear Hills ore in the presence of charcoal without addition of a chlorine source.

FIG. 2 sets forth the first example which is included to show the limits of directly reducing a sample of Clear Hills ore without the addition of a chlorine source.

The reaction product was screened with 90% of the total iron content residing in the coarse fraction. This fraction was ground and then magnetically separated. The magnetic fraction, the iron concentrate, recovered only 17% of the total iron and was of low grade, 65.4% iron by analysis.

EXAMPLE II

Figure 3:
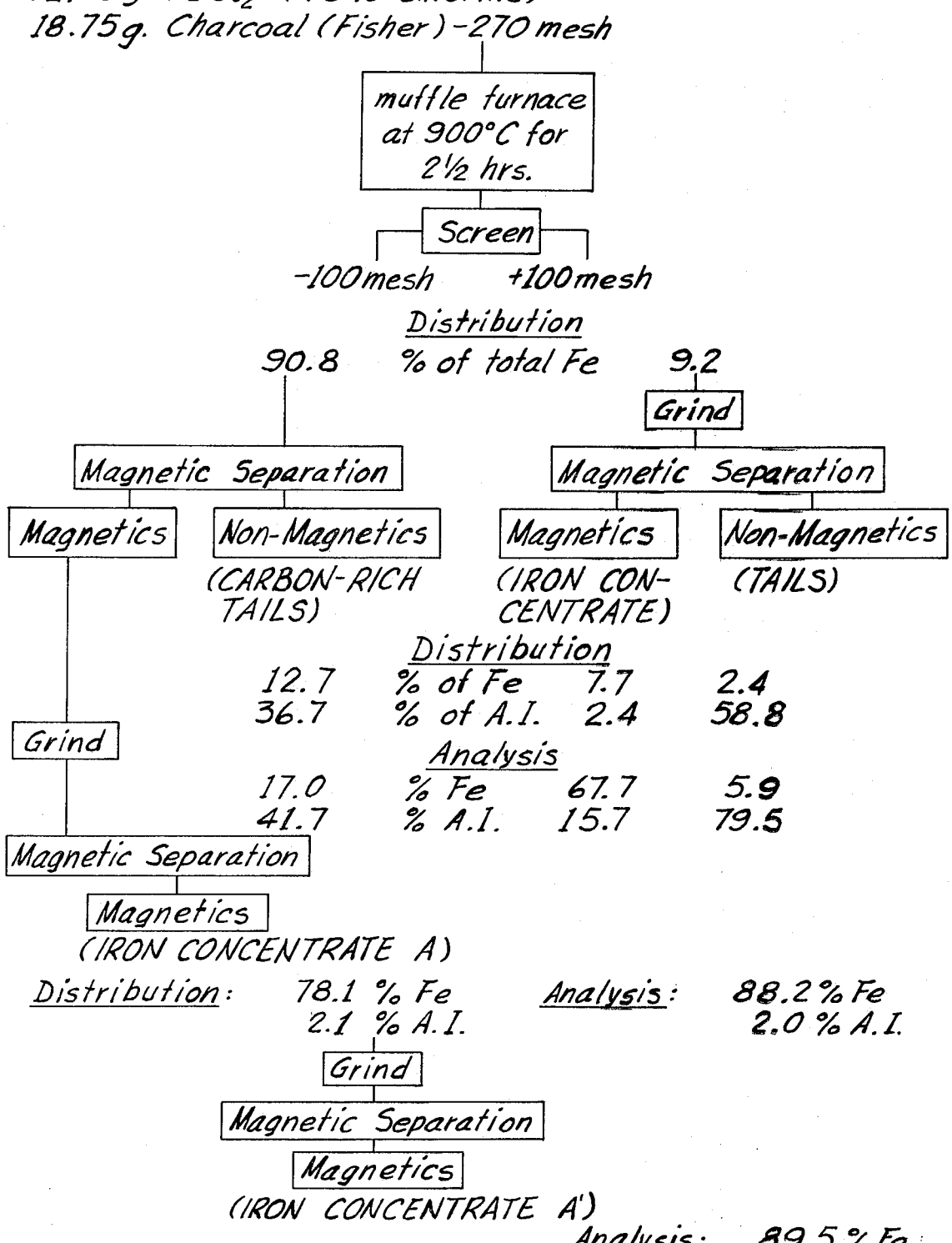
FIG. 3 is a flow diagram and tabular data for an example in which ferrous chloride was included in the reaction mixture.

Example II, set forth in FIG. 3, illustrates that two types of metallic iron concentrate are obtained by reduction of the ore in the presence of a chlorine source in accordance with the reaction conditions previously described.

The work-up of the reactive mixture followed the scheme shown in FIG. 3 and the analysis of the various fractions of the reaction product is presented. The separation procedure was incorporated to bring out the differentiation between the transported and non-transported iron products.

The greatest part of the iron was transported from the ore and reduced at sites near or on a carbon particle, thereby producing a relatively gangue-free, iron-rich, carbon-rich, fine and friable material.

The iron which was reduced in situ was found in the coarse ore particles. These coarse particles did not appear to deteriorate in size during the reduction process.

Each of the two fractions were further separated by magnetic procedures.

The quickest measure of the efficiency of the reaction was made by determining the percent iron recovered in the −100 mesh fraction. This efficiency was complicated in that it was meant to measure the total transported iron, but examination of the +100 fraction indicated that there was still metallic iron present therein. The iron in the +100 fraction appeared to be in three forms. The major visible content consisted of spherically shaped lumps of metallic iron which had compacted during the screening. In addition to the mainly iron-containing agglomerates there was iron metal loosely adhering to the ore particles. The third form of visible iron metal was a micro-crystalline type that was formed inside the ore particle. The iron particles were usually highly dispersed through the ore particle.

The following conclusion can be drawn from this example: when the invention was practiced, the greatest part of the iron contained in the ore particles was transported out of the particles and reduced to form iron particles which were amenable to effective separation from the gangue.

EXAMPLE III

Figure 4:
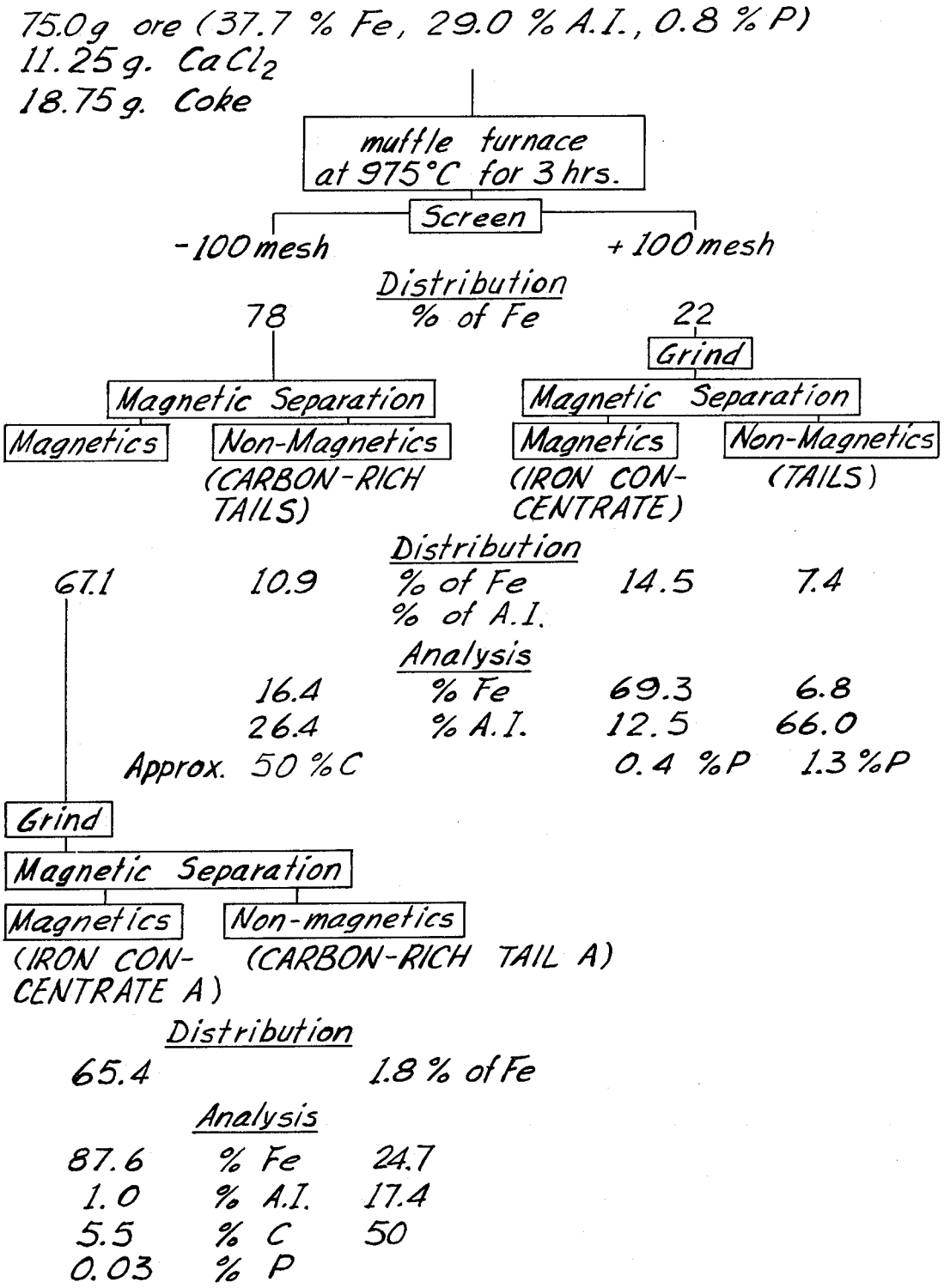
FIG. 4 is a flow diagram and tabular data for an example in which calcium chloride was included in the reaction mixture.

Example III, set forth in FIG. 4, serves to show that the transport effect is practiced when calcium chloride is used as the chlorine source. As illustrated in FIG. 4, the iron concentrate obtained in the coarse fraction after preliminary screening and a magnetic separation was of poor quality. The non-magnetics constituted the bulk of the gangue; however, a small amount of iron still remained, this being the % iron not recovered in the process. The fine fraction, when subjected to magnetic separation, yielded a high grade iron concentrate, the desired product, and carbon-rich tails which could be recycled.

EXAMPLE IV

This Example, set forth in FIG. 5, illustrates the results obtained from the practice of the invention on Snake River ore from the Yukon Territory. The iron minerals in this ore are fine-grained and intimately dispersed throughout the high silica gangue, making it a hard-to-beneficiate ore.

The iron concentrate recovered in batch tests was low in iron recovery, but also extremely low in both gangue and phosphorous.

EXAMPLE V

Figure 6:
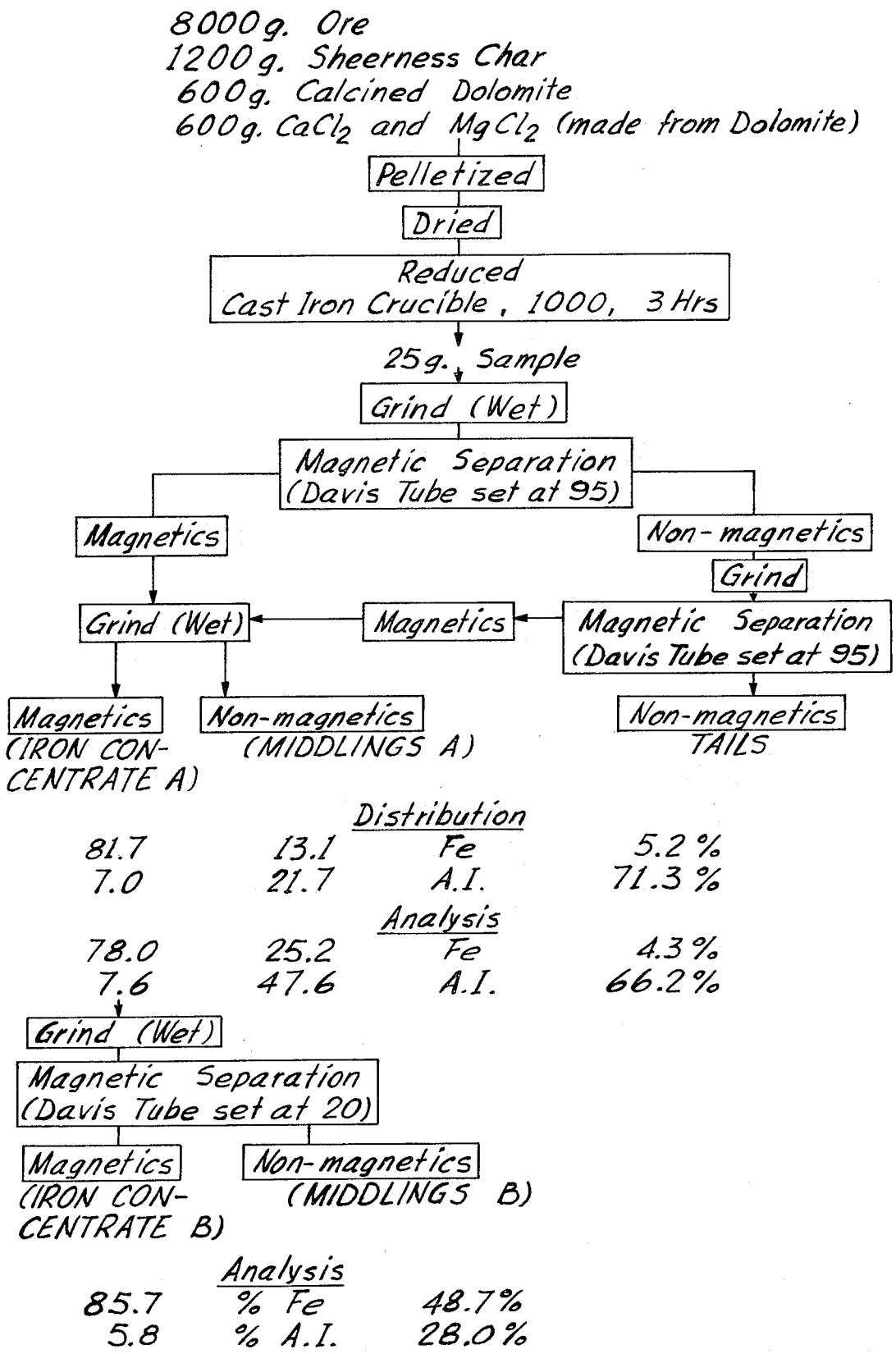
FIG. 6 is a flow diagram and tabular data illustrating the effect of calcium chloride acting in conjunction with char.

This Example, set forth in FIG. 6, shows the effect of calcium chloride acting in conjunction with char.

The general procedure was to pelletize the ore and carbon mixture using a 16-inch disc pelletizer and an aqueous chloride solution as a wetting agent. The pellets were placed in a large crucible, covered with a loose cover, and placed in a gas-fired muffle furnace. The heating procedure was to pre-dry the pellets at a low temperature and then rapidly bring the temperature of the furnace to the desired temperature, holding it there for the desired length of time. The temperature was monitored inside the furnace but external to the reaction vessel.

This example also illustrates the effect that calcium has on the phosphorous content of the iron concentrate. The in-place reduced non-transported iron concentrate from the +100 mesh fraction contains 0.4% P while the −100 mesh transported iron concentrate contains 0.03% P. In contrast, the iron concentrate obtained from the −100 mesh fraction in Example II, where ferrous chloride was used as the chlorine source, contained 0.4% P.

EXAMPLE VI

Figure 7:
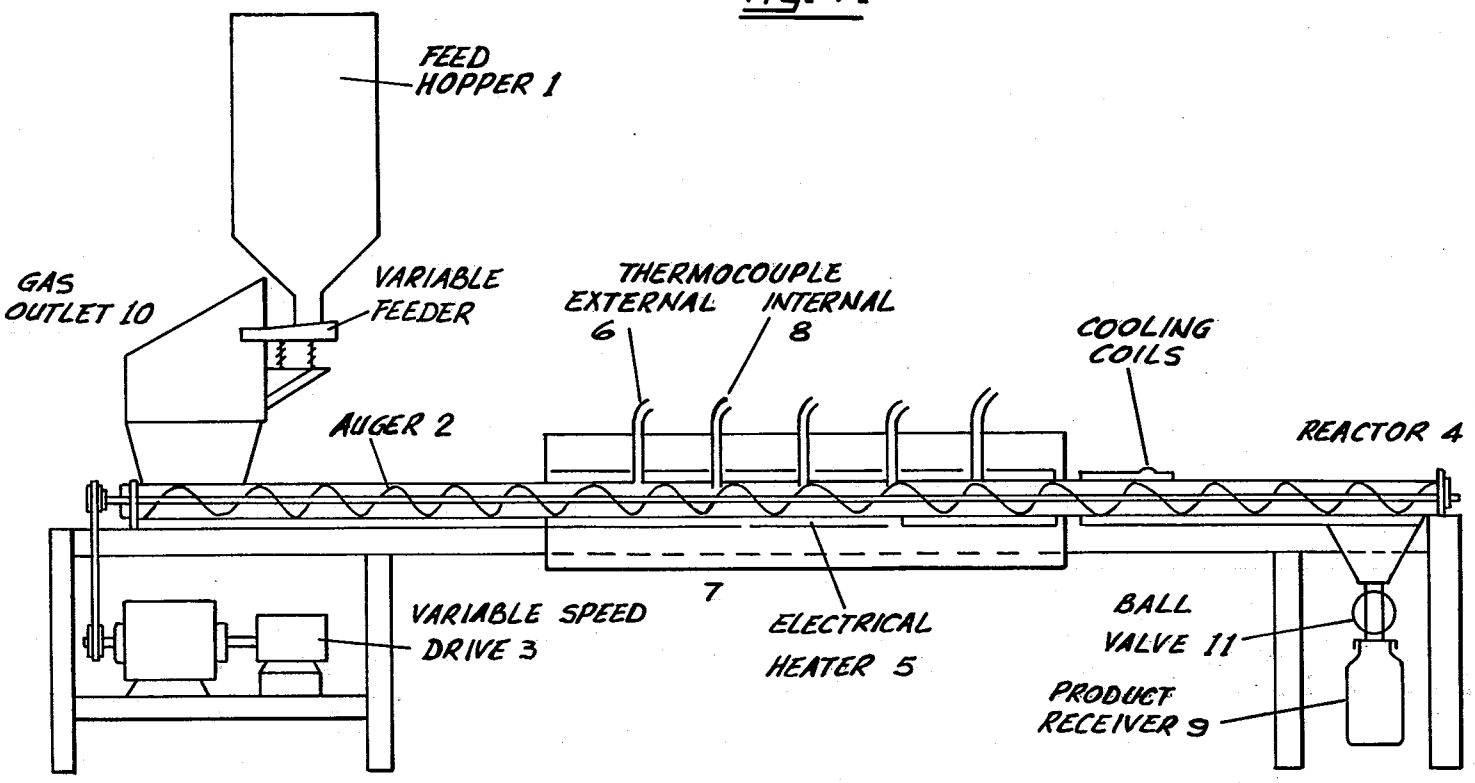
FIG. 7 is a schematic diagram of the reactor used in the development of the process of the present invention.

The present invention was also practiced in a continuous fashion in a reactor, shown in FIG. 7. The reaction mixture was introduced into the feed hopper 1. A 2-inch stainless steel screw conveyor 2 moved the particulate reaction mixture through a three-foot heated reaction zone 70. The rate of movement through the reactor was controlled by a variable speed drive 3 attached to the screw 2. The reactor 4 was indirectly heated by an electrical resistance heater 5. The temperature was measured and controlled by thermocouples 6 held tightly to the outside surface of the stainless steel tube enclosing the reaction zone 7. Additional thermocouples 8 were attached to the reactor to allow measurement of internal reaction temperatures. The reactor products were cooled as they left the reaction zone 7 and were removed in batches from the reactor 4 by means of a gas-tight ball valve 11. The gas tight product receiver 9 forced the generated reaction gases to move counter to the direction of the solids flow, thus passing them through the incoming cold solid ore. The reaction gases were vented from the reactor 4 through an outlet 10 at the upstream end.

With reference now to Table I, the ingredients were blended together before being added to the feed hopper. The reactor was preheated to 910° C. The material was fed in at a rate so as to provide a one hour residence time in the three foot reactor hot zone. The outside temperature of the stainless steel tube reactor was maintained at (910±5)° C.; the resulting inside temperature steadied at (870±5)° C. close to the feed end of the hot zone and diminished to (808±5)° C. at within six inches of the discharge end of the reaction zone.

TABLE 1

Continuous Reduction Employing Reactor

| | Feed Stock |
|---|---|
| Clear Hills ore | pre-dried, −10 +65 mesh |
| $FeCl_2 \cdot \times H_2O$ | addition rate of 4 g Cl/100 g ore |
| carbon | sub-bitumen coal char ground 20 min in rod mill addition rate of 20 g/100 g ore |
| $CaCO_3$ | fine addition rate of 2 g/100 g ore |

Davis Tube Magnetic Separation

| | Analysis | | Distribution | |
|---|---|---|---|---|
| Sample | % A.I. | % Fe | % of A.I. | % of Fe |
| after 6 hours | | | | |
| Tails | 64.9 | 7.8 | 75.7 | 7.4 |
| Middlings | 51.9 | 13.7 | 20.2 | 4.3 |
| Concentrate | 3.4 | 91.5 | 4.0 | 88.3 |
| reseparated concentrate | 2.0 | 93.8 | — | — |
| after 13 hours | | | | |
| Tails | 63.2 | 6.7 | 74.7 | 5.9 |
| Middlings | 47.0 | 16.4 | 21.2 | 5.5 |
| Concentrate | 3.1 | 89.8 | 4.1 | 88.6 |
| after 19 hours | | | | |
| Tails | 62.7 | 6.3 | 76.0 | 5.7 |
| Middlings | 47.7 | 16.2 | 20.9 | 5.4 |
| Concentrate | 2.3 | 91.4 | 3.0 | 88.9 |

The product was sampled at regular intervals over the 24 hour run. The run metallization increased to over 90% of the iron oxides present in the charge and remained near or above this range for the remainder of the run. The separability of the iron from the gangue was demonstrated by mild mortar and pestle grinding of the selected samples and Davis tube magnetic separation of the sample into 3 products. The tails were mainly iron depleted ore, the middlings were slightly magnetic, and the concentrate was the highly magnetic fraction. Table II shows the results of the three separated samples.

Analysis for chlorides in the reactor products revealed that the majority of the chloride fed into the reactor was still present in the discharged products with very little lost with the reaction gases.

Figure 8:
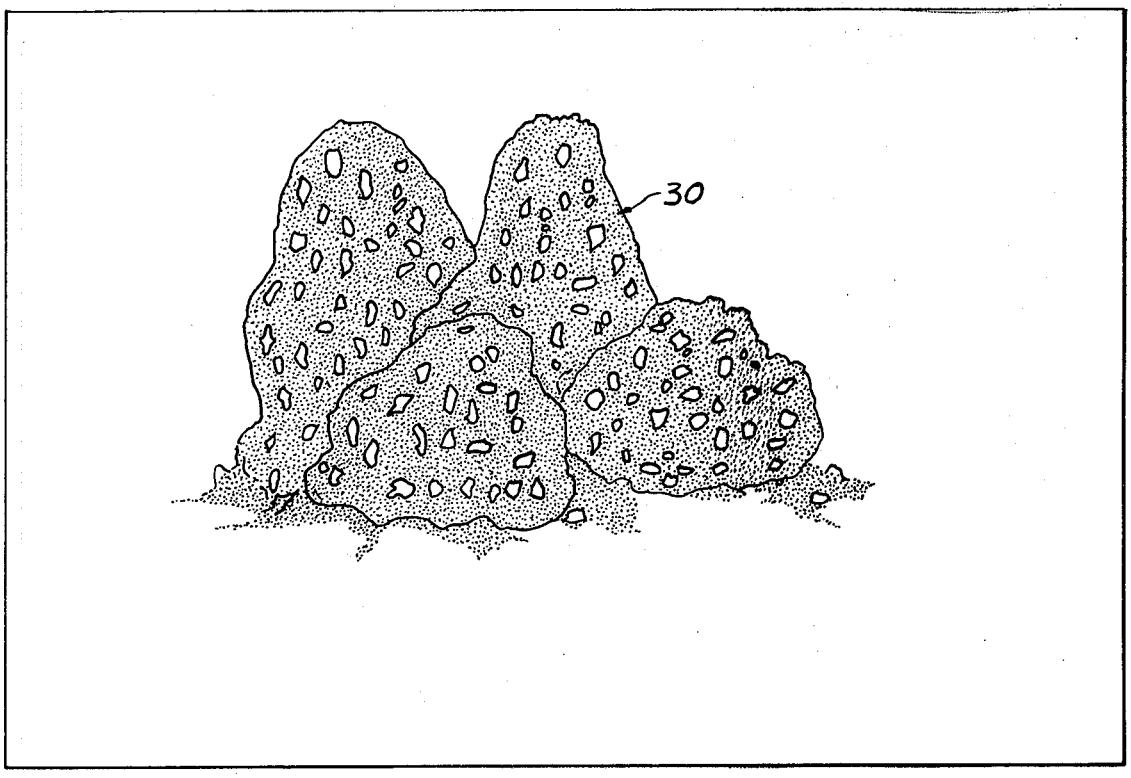
FIG. 8 is a representation of the reaction product obtained by practice of the present invention.
Figure 9:
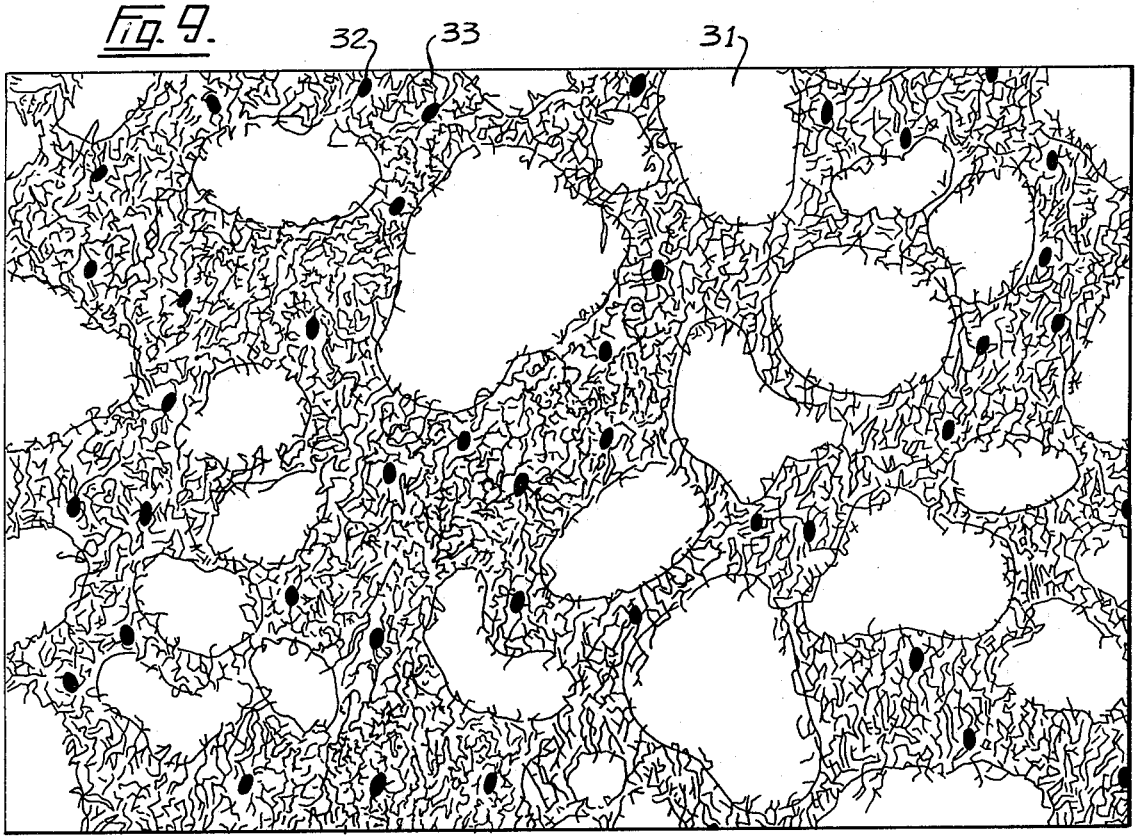
FIG. 9 illustrates the product of FIG. 8 at 40× magnification.
Figure 10:
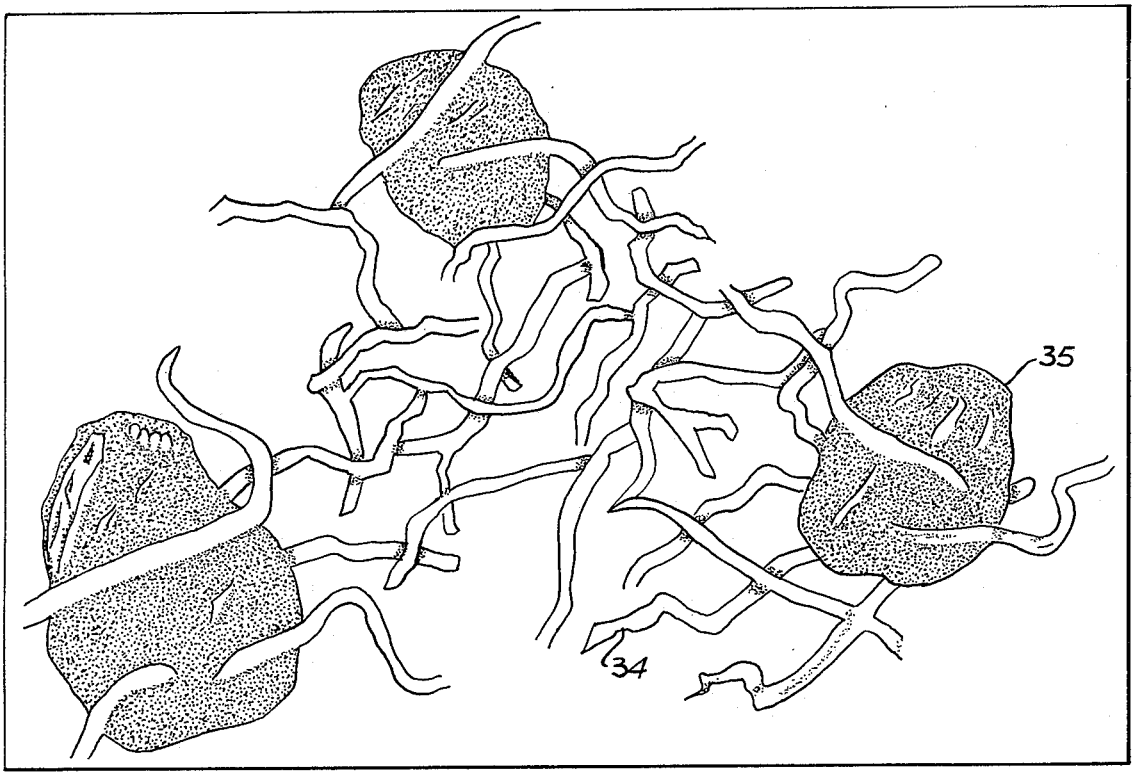
FIG. 10 illustrates the product of FIG. 8 at 800× magnification.

The reaction product is shown in FIG. 8 and is composed of agglomerates held together by metallic iron. A microscopic investigation of the agglomerates at 40× magnification, shown in FIG. 9, has indicated that the reaction product is a plurality of agglomerates consisting of iron depleted ore particles 31 and carbonaceous reductant 32 held together by strands of interwoven metallic iron 33. The iron 33 has been transported from within the ore particles and has metallized in the interstitial spaces between said ore particles. When the iron was examined under a microscope at 800× magnification, shown in FIG. 10, it was found to consist of interwoven fine strands 34 of substantially metallic iron closely associated with the carbonaceous reductant 35.

EXAMPLE VII

This Example demonstrates the use of dried coal as a carbon source. It also demonstrates that the chlorine application can be lowered to a level of 3 grams of chloride per 100 grams of ore while still obtaining a high level of metallization and recovery, as shown in Table II. Finally, it shows the importance of maintaining the bed temperature below about 950° C.

TABLE II

| | Feed Stock |
|---|---|
| Clear Hills ore | pre-dried, −10 +65 mesh |
| $FeCl_2 \cdot \times H_2O$ | addition rate of 4 g Cl/100 g ore |
| Carbon | dried sub-bituminous coal ground 20 min. in rod mill addition rate of 20 g/100 g ore |
| $CaCO_3$ | addition rate of 2 g/100 g ore |

Davis Tube Magnetic Separation

| | Analysis | | Distribution | |
|---|---|---|---|---|
| Sample | % A.I. | % Fe | % of A.I. | % of Fe |
| after more than 3 hours | | | | |
| Tails | 65.2 | 6.2 | 73.2 | 4.6 |
| Middlings | 51.4 | 16.0 | 22.6 | 4.7 |
| Concentrate | 2.9 | 94.3 | 4.2 | 90.6 |

The outside temperature of the reactor was maintained at 910° C. The inside temperatures steadied to 870° C. six inches from the feed end and to 795° C. six inches from the product discharge end. A reaction time of 1 hour was allowed.

A high degree of metallization in the solid product was attained almost as rapidly as for a 4 gram chloride per 100 gram ore feed rate. A chloride analysis of the product again revealed that the majority of the chloride was leaving the reactor with the solid product.

The reactor is limited to operation below about 950° C. When the reactor was operated above this temperature, accretions formed on the inside of the tube which severely damaged the screw. In addition if fine material was used in the reactor (i.e., ore ground to less than 100 mesh) accretions again built up and damaged the screw.

EXAMPLE VIII

In this Example, Marquette iron ore from the Tilden mine in Michigan was used in the continuous reactor.

The reactor was operated for two retention times at the 910° C. temperature, one at 1 hour and one at 30 minutes. The details of the two tests are shown in Table III.

TABLE III

| | Feed Stock |
|---|---|
| Marquette ore | −10 +65 mesh |
| $FeCl_2 \cdot \times H_2O$ | addition rate of 4 g/100 g ore |
| Carbon | sub-bituminous coal char ground 20 min. in rod mill addition rate 20 g/100 g ore |
| $CaCO_3$ | addition rate 2 g/100 g ore |

Davis Tube Magnetic Separation

| | Analysis | | Distribution | |
|---|---|---|---|---|
| Sample | % A.I. | % Fe | % of A.I. | % of Fe |
| Outside Reactor Temperature (910 ± 5)° C. | | | | |
| 2 Hours after 1st sample from 1 hour retention time | | | | |
| Tails | 85.9 | 2.8 | 95.1 | 4.4 |
| Middlings | 52.1 | 11.9 | 4.2 | 1.3 |
| Concentrate | 1.0 | 95.7 | 0.7 | 94.3 |
| 2 Hours after changing to 30 min. retention time | | | | |

TABLE III-continued

| | | | | |
|---|---|---|---|---|
| Tails | 83.4 | 3.3 | 87.4 | 4.9 |
| Middlings | 55.2 | 10.9 | 11.3 | 3.2 |
| Concentrate | 1.9 | 91.8 | 1.3 | 91.9 |
| Outside Reactor Temperature (880 ± 5)° C. | | | | |
| 1 hour retention time | | | | |
| Tails | 85.0 | 3.4 | 90.1 | 6.0 |
| Middlings | 59.5 | 9.1 | 9.2 | 2.1 |
| Concentrate | 1.1 | 94.0 | 0.7 | 91.9 |
| 30 Min. retention time | | | | |
| Tails | 83.1 | 5.3 | 88.6 | 9.1 |
| Middlings | 55.6 | 13.1 | 10.2 | 3.9 |
| Concentrate | 2.1 | 92.8 | 1.1 | 87.0 |

The same feed was added to the continuous reactor at 880° C. for the same time, one hour and 30 minutes. These retention times and the results are also shown in Table III.

This example shows the slight decrease in both yield and quality when the retention time is decreased, and it also demonstrates the generally minor change in the quality of the iron product when the shell temperature is slightly reduced.

The analysis of chlorides in the reaction product showed that larger quantities of chlorine were migrating with the gases. This was demonstrated by samples of the feed material that were taken just in front to the heater zones which showed chloride concentrations of up to 7% chloride.

The embodiments of the invention in which an exclusive property or privilege is claimed are defined as follows:

1. A method for beneficiating ground oxidized iron ore containing silica comprising:

introducing the ore, a chlorine source and a particulate carbonaceous reductant into a reaction vessel;

the amount of the chlorine source being less than 15 wt. % of the ore, the amount of reductant being greater than that required to effect the reduction of the total iron content of the ore;

indirectly heating the mixture in the vessel without exceeding 950° C., while retaining the reaction gases in intimate contact with the ore without significant dilution of said gases to thereby provide a reducing atmosphere, for a sufficient period of time so as to cause the greatest part of the iron in the ore to be transported out of the ore particles to reduction sites adjacent the reductant where the iron is metallized thereby forming an agglomerate of iron-depleted ore particles and carbonaceous reductant held together by a matrix of interwoven fine strands of substantially metallic iron.

2. The method as set forth in claim 1 wherein:

the chlorine is provided in the form of metal chloride and the amount of said metal chloride is less than 15 wt. % based on the ore; and the reductant is selected from the group consisting of coal, coke, char and charcoal and is provided in an amount in excess of 10 wt. % based on the ore.

3. The method as set forth in claim 2 wherein:

the ore, chlorine source and reductant mixture is continuously moved countercurrent to the reaction gases.

* * * * *